US005100046A

United States Patent [19]

Allegrucci et al.

[11] Patent Number: 5,100,046

[45] Date of Patent: Mar. 31, 1992

[54] MONOBLOC POINTS FOR GROOVED RAILS AND METHOD FOR MAKING SAME

[75] Inventors: Jean-Pierre Allegrucci, Schifflange; Charles Risch, Rumelange, both of Luxembourg

[73] Assignee: Kihn S.a.r.l., Luxembourg

[21] Appl. No.: 516,297

[22] Filed: Apr. 5, 1990

[51] Int. Cl.[5] ..... E01B 7/02; E01B 7/06; B23K 31/02

[52] U.S. Cl. ..... 228/170; 228/182; 29/415; 29/558; 409/143

[58] Field of Search ..... 228/170, 182, 198, 241; 29/16, 415, 557, 558; 409/143

[56] References Cited

U.S. PATENT DOCUMENTS

| | | | |
|---|---|---|---|
| 1,074,089 | 9/1913 | Moore | 29/415 |
| 2,030,704 | 2/1936 | Langford | 29/557 |
| 3,441,999 | 5/1969 | Perdue et al. | 29/415 |
| 3,661,480 | 5/1972 | Förschner et al. | 29/558 |
| 3,708,856 | 1/1973 | Keifer | 29/402.18 |
| 3,751,795 | 8/1973 | Favre | 29/557 |
| 3,821,840 | 7/1974 | Kershaw | 228/46 |
| 4,534,093 | 8/1985 | Jahnke et al. | 409/235 |
| 4,634,087 | 1/1987 | Kempa | 246/430 |

FOREIGN PATENT DOCUMENTS

| | | | |
|---|---|---|---|
| 367672 | 11/1978 | Austria | 228/241 |

*Primary Examiner*—Samuel M. Heinrich
*Attorney, Agent, or Firm*—Fishman, Dionne & Cantor

[57] ABSTRACT

A method for making monobloc points for a transporation rail is disclosed. The points include a profiled body having a groove for housing a point rail. The method includes selecting a steel bloom having dimensions at least equal to the outer dimensions of the body and machining the steel bloom to define the profiled body.

5 Claims, 2 Drawing Sheets

Fig. 2
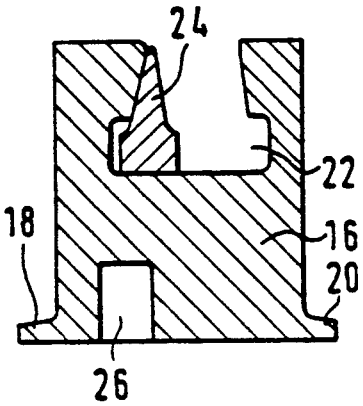
Fig. 3
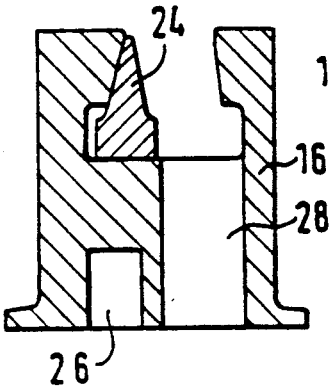
Fig. 4
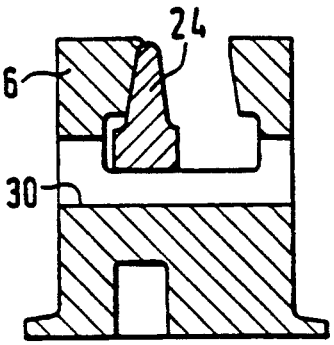
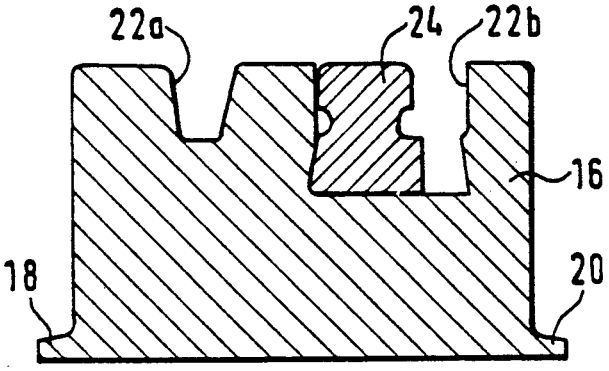
Fig. 5
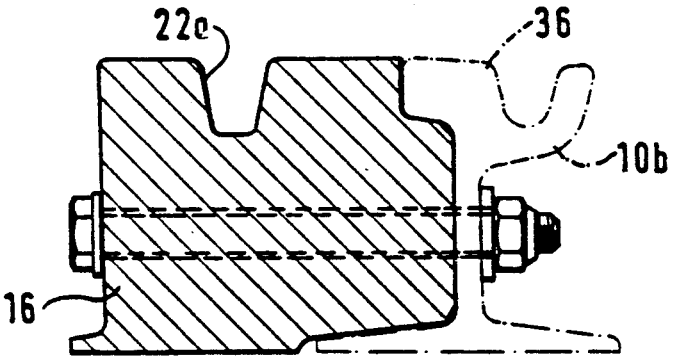
Fig. 6

MONOBLOC POINTS FOR GROOVED RAILS AND METHOD FOR MAKING SAME

TECHNICAL FIELD

The present invention relates to a method of manufacturing points for grooved or tramway rails, and to monobloc points made by application of this method.

Without being restricted thereto, the invention more particularly concerns points for tramways for urban transport systems or port installations where the rails are embedded in the roadway surface.

BACKGROUND OF THE INVENTION

Points for transportation rails are generally composed of an assembly of various components which are of different qualities and shapes and are made to measure either by machining and assembly by hand, usually be welding, or by casting.

The fact that it is necessary to use a large number of components of special qualities and shapes greatly complicates procurement and production.

The manufacture of points by assembly of these components not only makes automation impossible, but in addition calls for a large skilled labor force, particularly for the welding work.

SUMMARY OF THE INVENTION

The aim of the present invention is to provide a new method for manufacturing points of the type described above, which enables the finished product to be improved both through the intrinsic quality of the material and through a reduction of manufacturing tolerances.

In order to achieve this aim, the method proposed by the present invention is essentially characterized in that it consists in selecting rolled, forged or other steel blooms having a length at least equal to the length of the points, and, over the entire length, a section at least equal to all the sections of the body, and in that said blooms are subjected to machining exclusively by chip removal for the purpose of forming the outside and inside profiles of the body.

The machining preferably consists of automatic milling under programmed control. This machining may be followed by surface hardening heat treatment or by resurfacing by the addition of hard metal.

The opposite ends of the points body are preferably fixed by welding to the track rails.

The monobloc points produced by the present invention make it possible to apply almost complete automation, human intervention being reduced to control and supervision work. This results in improved productivity and increased production capacity, with better guarantee of the quality and reliability of the end product.

The monobloc design is in addition a better guarantee of uniform quality of the finished product, because weak parts, such as for example welds highly vulnerable to stress and wear, are eliminated.

In addition, it is possible for the manufacturer to choose the quality of the steel of the blooms, for example in accordance with the stresses, or in accordance with the track in order not to disturb the homogeneity of the latter. Thus, for example carbon steel enables the ends of the points to be welded to the track, thus eliminating conventional joints and improving environmental conditions by substantially reducing noise.

BRIEF DESCRIPTION OF THE DRAWINGS

Other features and characteristics will emerge from the description of one advantageous embodiment given below by way of example and with reference to the accompanying drawings, in which:

FIGS. 2 to 6 show cross-sections in the sectional planes defined respectively by A, B, C, D and E in FIG. 1.

DETAILED DESCRIPTION OF THE INVENTION

Figure 1:
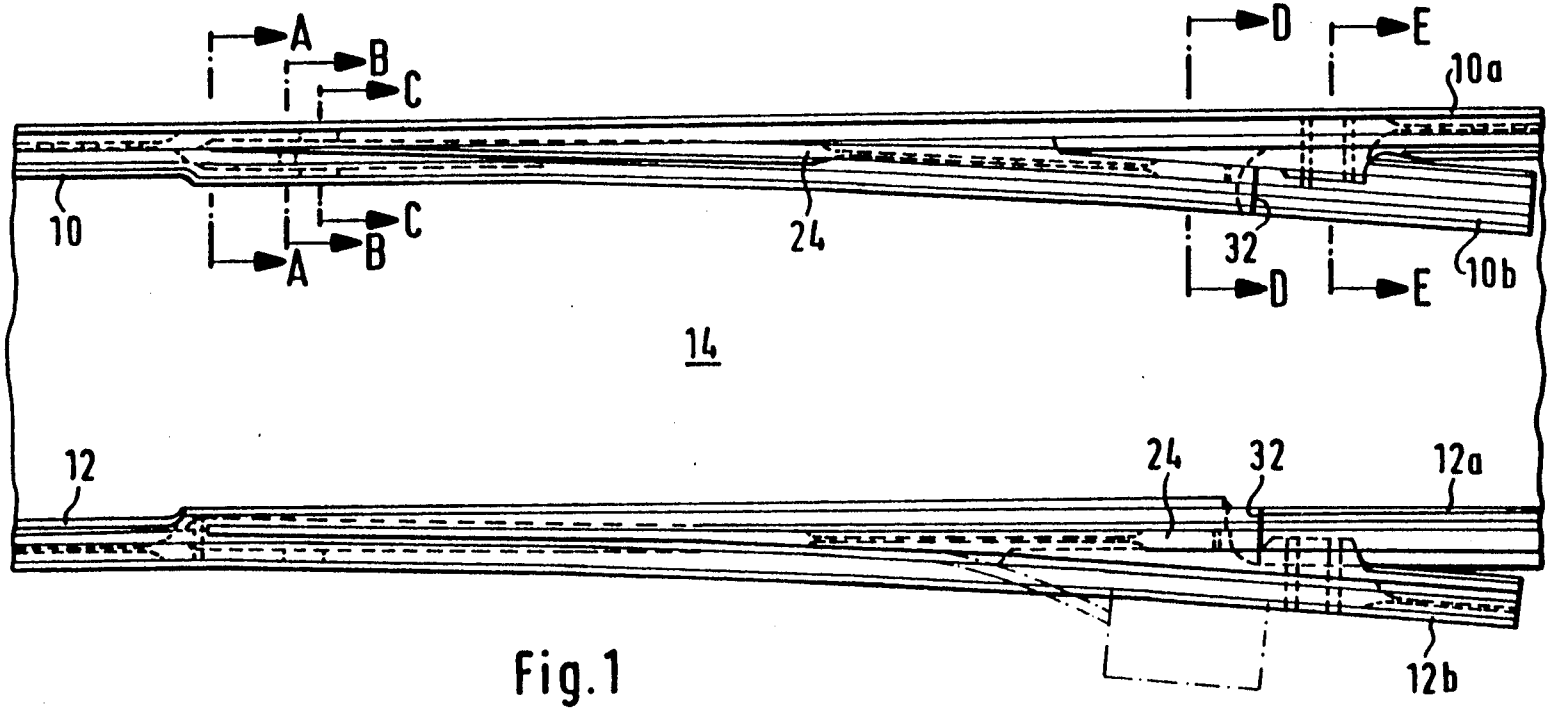
FIG. 1 shows a schematic plan view of a set of points.

FIG. 1 shows a pair of rails 10, 12 which are extended by points 14 intended to guide a train either onto the pair of rails 10*a*, 12*a* or onto the pair of rails 10*b*, 12*b*. The points operated in conventional manner, and only the method of manufacturing them, and consequently the profile of the bodies of the points, are different from the prior art. This profile is illustrated by the different sections shown in FIGS. 1 to 6.

FIG. 2 shows a cross-section of a body 16 at the tip of a point rail 24. This body 16 of substantially rectangular section preferably has two projecting edges 18, 20 forming the fastening flanges extending corresponding flanges on the rail 10. The body 16 has a groove 22 forming the housing for a point rail 24, the tip of which is shown in FIG. 2. The bottom of the groove 22 is horizontal and forms the slides guide for the point rail 24 enabling the latter to be displaced transversely from the position shown in FIG. 2 towards the right, against the flank, on the opposite side of the groove 22 and vice versa. The left-hand flat top edge of the body 16, extending along the groove 22, forms the tread. An internal longitudinal groove 26 permits the passage of heating pipes (not shown).

FIG. 3 shows the same body 16 in a section taken a little further downstream, at the vertical hole 28 passing through the body 16 and serving for evacuation of rainwater and rinsing water.

At the point where the section shown in FIG. 4 is taken, the body 16 has a horizontal bore 30 intended to receive the operating means for the point rail 24.

FIGS. 5 and 6 show sections of the body 16 at the end of the points. As shown in these two figures, the body 16 is wider at the end of the points, because it must have two grooves 22*a* and 22*b*, corresponding respectively to the rails 10*a* and 10*b*.

FIG. 5 shows a section at the end of the points, particularly where the point rail 24 is widened to provide a tread corresponding to that of the rails 10*b* and 12*a*. The point rail 24 may be joined to these rails by welding, as shown at 32, thus permitting a very good transition. The connection may however also be made by means of a joint; in which case the point rail 24 is fastened by means of a key, thus enabling the point rail to be more easily detached.

FIG. 6 shows a section through the body 16 taken beyond the junction to the rail 10*b* and before the junction with the rail 10*a*, at which point the groove 22*b* has given way to the groove 36 in the rail 10*b*. The fastening between the rail 10 and the body 16 is made by bolting.

The part of the points situated between the rail 12 and its extensions 12*a* and 12*b* is composed similarly to the above description.

According to the present invention each body 16 is entirely manufactured by machining, both as regards it external shape and as regards its internal profile particularly the grooves 22, 22*a* and 22*b*, the groove 26, the hole 28 and the bore 30. This machining is carried out with the aid of a milling machine, preferably automatically under programmed control. The starting material is a rolled bloom, the quality of the steel of which can easily be determined by the manufacturer of the points. These blooms must necessarily have a length at least equal to the total length of the points and a constant or variable section making it possible, by the milling, to reduce the profile to the different sections which follow one another over the entire length of the body, and of which some are shown in FIGS. 2 to 6. In other words, if the section of the bloom is constant over its entire length, its section must be at least equal to the largest section of the body 16, this section being situated at the end of the points, as shown in FIG. 5. However, this procedure would entail considerable milling to reduce the section of the bloom to the smaller sections of the body 16 at the beginning of the points, as shown in FIGS. 2 to 4.

In order to avoid such considerable machining, it is preferable to start with a bloom whose width substantially corresponds to the total of the maximum widths at the flanges 18 and 20 on the body 16 at the beginning and at the end of the points, that is to say the sum of the maximum widths of the sections shown in FIG. 2 and in FIG. 5. This bloom is then divided obliquely in the direction of its length in order to form two identical, symmetrical blooms whose widths vary progressively from the width of the flanges 18, 20 in FIG. 2 to the width of the flanges 18, 20 in FIG. 5, and vice versa.

After the body has been formed by external and internal machining of the blooms, it is possible to subject the body to local heat treatment or quenching in order to achieve surface hardening of the parts most subject to stresses. It is also possible to effect resurfacing by welding in order to increase strength locally.

Because it is possible to select the quality of the steel of the blooms constituting the starting material, the machined monobloc points according to the present invention can be easily be connected on site to the rails of the track, preferably by welding and in particular by aluminothermic welding, thus enabling the joint between the points and the track to be eliminated and achieving track continuity.

While preferred embodiments have been shown and described, various modification and substitutions may be made thereto without departing from the spirit and scope of the invention. Accordingly, it is to be understood that the present invention has been described by way of illustrations and not limitations.

What is claimed is:

1. A method for making points for a transportation rail, said points including a profiled body, said profiled body extending from a front end along a longitudinal axis for a predetermined length to a second end, having a predetermined height and having a width that varies with position along the longitudinal axis, and said body including a groove for housing a point rail, a guide surface within the groove for guiding the point rail and a tread surface extending along the groove; comprising:

selecting a steel bloom having a length at least equal to the length of the body, having a height at least equal to the height of the body and having a width at each point along the length of the bloom which is at least equal to the width of the body at a corresponding point along the length of the body; and machining said steel bloom, by chip removal, to define the profiled body.

2. The method of claim 1, wherein the machining is effected by automatic milling under programmed control.

3. The method of claim 1, further comprising:

heat treating the profiled body, subsequent to the step of machining, to harden the surface of the profiled body.

4. The method of claim 1, further comprising:

welding the profiled body to a transportation rail.

5. The method of claim 1, wherein the profiled body has a first width at the first end and second width at the second end and wherein the bloom selected has a uniform width at least equal to the first and second width combined, further comprising:

dividing the bloom in a direction oblique its length to form a pair of identical half blooms, each extending form a first end to a second end and having a width that is progressively variable from the first end to the second end.

* * * * *

UNITED STATES PATENT AND TRADEMARK OFFICE

CERTIFICATE OF CORRECTION

PATENT NO. : 5,100,046

DATED : March 31, 1992

INVENTORS : Jean-Pierre Allegrucci and Charles Risch

It is certified that error appears in the above-identified patent and that said Letters Patent is hereby corrected as shown below:

In the Abstract, Rows 1-2, delete "transporation" and insert therefore --transportation--.

Col. 1, Row 19: Delete "be" and insert therefore --by--.

Col. 1, Row 66: Delete "wellded" and insert therefore --welded--.

Col. 3, Row 44: Before "easily", delete "be".

Col. 4, Row 43: In the phrase "form a first", delete "form" and insert therefore --from--.

Signed and Sealed this

Nineteenth Day of October, 1993

*Attest:*

Bruce Lehman

BRUCE LEHMAN

*Attesting Officer*

*Commissioner of Patents and Trademarks*